US006581345B2

(12) United States Patent
Goldsmith et al.

(10) Patent No.: US 6,581,345 B2
(45) Date of Patent: Jun. 24, 2003

(54) TRACK CONCEALING SYSTEM FOR OPERABLE WALLS

(75) Inventors: Thomas L. Goldsmith, Earlville, IA (US); N. Douglas Owens, Lynn, IN (US)

(73) Assignee: Modernfold, Inc., New Castle, IN (US)

( * ) Notice: Subject to any disclaimer, the term of this patent is extended or adjusted under 35 U.S.C. 154(b) by 43 days.

(21) Appl. No.: 09/825,038

(22) Filed: Apr. 3, 2001

(65) Prior Publication Data

US 2001/0032424 A1 Oct. 25, 2001

Related U.S. Application Data

(60) Provisional application No. 60/194,212, filed on Apr. 3, 2000.

(51) Int. Cl.[7] ..... E04H 1/00; E04H 14/00; E04H 3/00; E04H 5/00; E04H 6/00

(52) U.S. Cl. ..... 52/243.1; 52/71; 52/238.1

(58) Field of Search ..... 52/243.1, 70, 71, 52/238.1, 473

(56) References Cited

U.S. PATENT DOCUMENTS 5,481,840 A * 1/1996 Dickson ..... 52/241
5,544,462 A * 8/1996 Kordes ..... 160/196.1
5,551,499 A * 9/1996 McRoberts ..... 160/199
5,577,348 A * 11/1996 Keller ..... 160/40
5,603,192 A * 2/1997 Dickson ..... 52/235
6,082,053 A * 7/2000 Bischof et al. ..... 49/221
6,296,038 B1 * 10/2001 Chen ..... 160/118
6,393,772 B1 * 5/2002 McRoberts et al. ..... 49/409

FOREIGN PATENT DOCUMENTS

EP 0174172 * 9/1985 ..... E06B/5/00
JP 6-93773 * 9/1992 ..... E06B/3/32

* cited by examiner

*Primary Examiner*—Carl D. Friedman
*Assistant Examiner*—Chi Q. Nguyen
(74) *Attorney, Agent, or Firm*—Baker & Daniels

(57) ABSTRACT

The present invention provides a track concealment system for use with a movable wall system having movable walls, a track and a trolley. The invention includes a pair of panels, each sized to conceal a portion of the track, and a pair of brackets each having a first portion attachable to the track and a second portion configured to support an edge of a corresponding panel. When supported by the second portion, the panels are arranged such that the edge of said panel is adjacent the connecting member thereby concealing the track.

12 Claims, 6 Drawing Sheets

TRACK CONCEALING SYSTEM FOR OPERABLE WALLS

This application claims the benefit of U.S. Provisional Application No. 60/194,212, filed Apr. 3, 2000.

BACKGROUND OF THE INVENTION

The present invention pertains to operable walls movable to partition large rooms into smaller rooms, and, in particular, to the overhead track for the operable wall.

Operable walls or partitions, also known as movable wall panel systems, find useful application in a variety of venues, such as classrooms, offices, convention facilities and hospitals. In these venues, the operable wall panels can be moved along tracks from which they are suspended to efficiently compartmentalize a larger room of interior space into a multitude of separate, smaller rooms. In particular, the operable wall panels are typically connected to trolleys that roll within an overhead track. The track is suspended from structural supports so as to be installed at a height of, or typically slightly above, the ceiling of the room being compartmentalized.

One shortcoming of existing tracks of operable walls is that many people consider their appearance to detract from the aesthetics of the room in which the operable walls are installed. For example, traditional tracks include soffit portions visible within the room and which flank on both sides the slot through which extend the bolts that span the trolleys and panels. The soffit portions, which in the past have been provided in several ways, such as laterally extending flanges integrally formed with a steel channel that forms the continuous track, or as pans that are secured to the hanger brackets by which the continuous track is suspended from the structural support, frequently are quite wide and naturally run the length of the track and therefore of the room being compartmentalized. Especially when the operable panels are arranged in their stacked positions, and even when the panels are arranged in their wall-forming positions directly below the track along its length, such soffit portions often stand in noticeable contrast to the ceiling in which they are installed because along their significant width they differ in material of construction, as well as possibly color, from the ceiling.

Another way in which existing tracks detract from the aesthetics of a room relates to the track slot, and is most noticeable when the panels of the operable wall are arranged in their stacked positions. The slot between the track soffit portions opens into the darkened interior of the track. As a result, the track slot often appears as a dark stripe along a lighter colored ceiling of the room.

Thus, it would be desirable to overcome these and other shortcomings of the prior art.

SUMMARY OF THE INVENTION

The present invention provides a track concealment system for use with a movable wall system having movable walls, a track and a trolley. The track defines a passageway, in which the trolley travels, and an opening, extending the length of the passageway through which a connecting member extends to connect the movable wall to the trolley. The invention includes a pair of panels, each sized to conceal a portion of the track, and a pair of brackets each having a first portion attachable to the track and a second portion configured to support an edge of a corresponding panel. When supported by the second portion, the panels are arranged such that the edge of said panel is adjacent the connecting member thereby concealing the track.

In one embodiment, the bracket can include a groove between the first portion and the second portion. The groove is configured to receive and hold a light strip or illuminating element. In this configuration, the track can serve the multipurpose tasks of providing additional lighting to the area and providing a track on which the trolley can travel.

In another aspect of the invention, at least one sweep is provided for concealing the connecting member. The sweep can be mounted to the edge of the movable wall. When mounted to the edge of the movable wall, the sweep can extend from the edge of the wall to the second portion of the bracket, thereby covering the connecting member. In addition, a rounded ridge may be defined in the second portion of the bracket. The rounded ridge can project inwardly toward the connecting member to limit the movement of the connecting member. The rounded ridge can also engage the sweep thereby securing the sweep in a position covering the connecting member.

One advantage of the present invention is that it allows for the better concealment of a track above the ceiling panels or materials of the room.

Another advantage of the present invention is that it may be adapted for use with existing track shapes.

Still another advantage of the present invention is that it is relatively inexpensive to manufacture and install.

Still another advantage of the present invention is that it provides for an illumination of the track interior, thereby reducing the contrast of the track path with a light colored ceiling so as to improve the aesthetics of a room.

BRIEF DESCRIPTION OF THE DRAWINGS

The above mentioned and other advantages and objects of this invention, and the manner of attaining them, will become more apparent and the invention itself will be better understood by reference to the following descriptions of embodiments of the invention taken in conjunction with the accompanying drawings, wherein.

Figure 1:
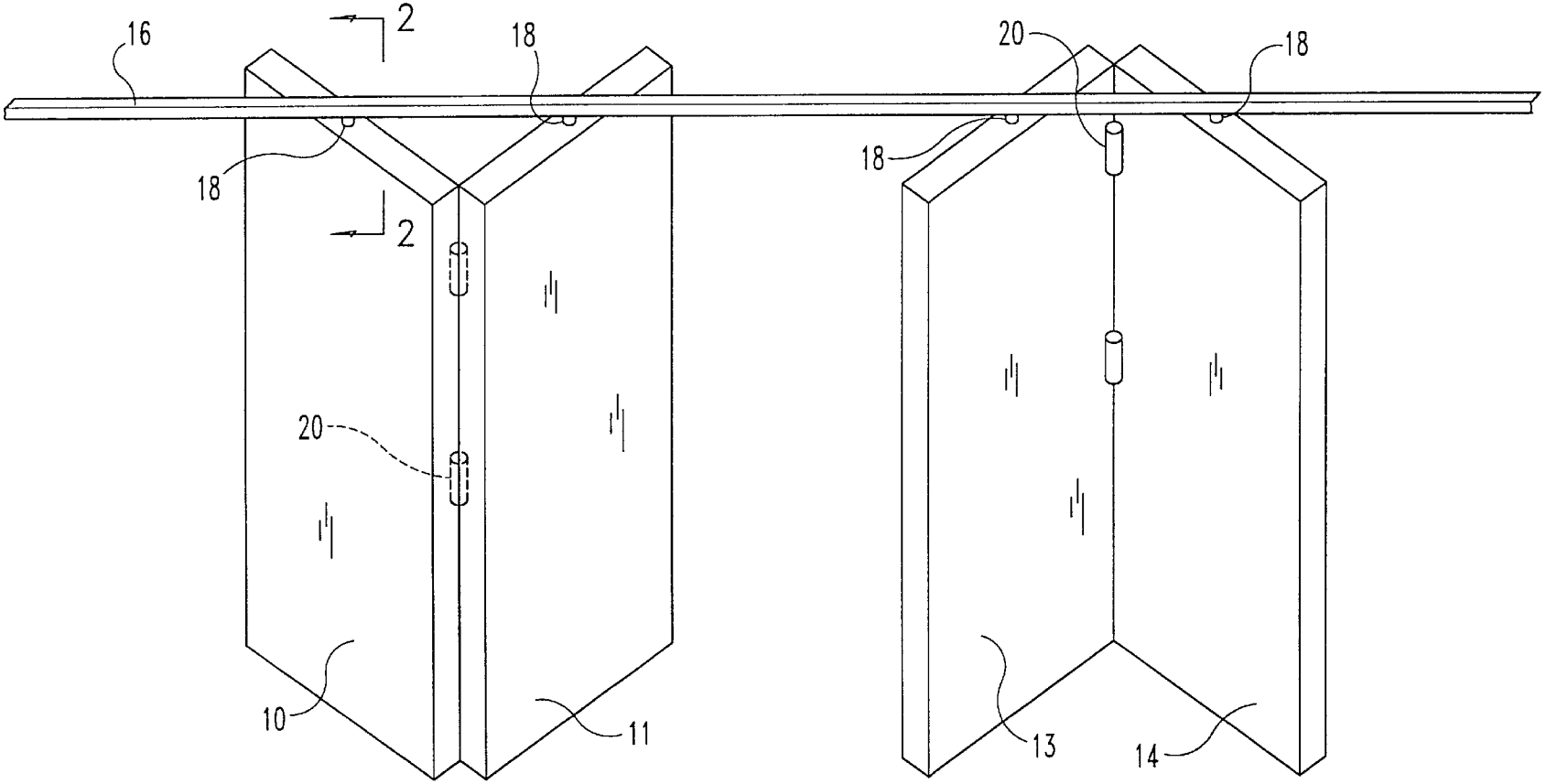
FIG. 1 is a diagrammatic perspective view of an operable wall with which the various embodiments of the track concealing system described herein may be employed.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

Referring now to FIG. 1, there is diagrammatically shown an operable wall which may be equipped with any of the track concealing systems of the present invention. The operable wall is shown as a paired panel system and includes operable partitions or wall panels 10, 11 and 13, 14 suspended from track 16 by trolleys 18. The term trolley is used generally herein and is intended to encompass devices, including wheeled carriages and carriers, of all types that are operably connected to and movable along the track. Wall panel 10 is linked to panel 11, and panel 13 is linked to panel 14, by multiple hinges 20 arranged along the panel height. Track 16 is mountable to a support structure above the room to be compartmentalized in a well known fashion, and the track parts along which the trolleys 18 ride is located above the ceiling of the room (not shown in FIG. 1) as further described below. Panels 10, 11 and 13, 14 may be moved along the track in any known fashion in wall stacking and wall extending directions. The wall panels may be of any conventional design. Furthermore, although shown as being employed with a paired panel system, the track concealing systems described herein may be employed with different panel systems, including single panel systems, and with different or non-straight track layouts.

Figure 2:
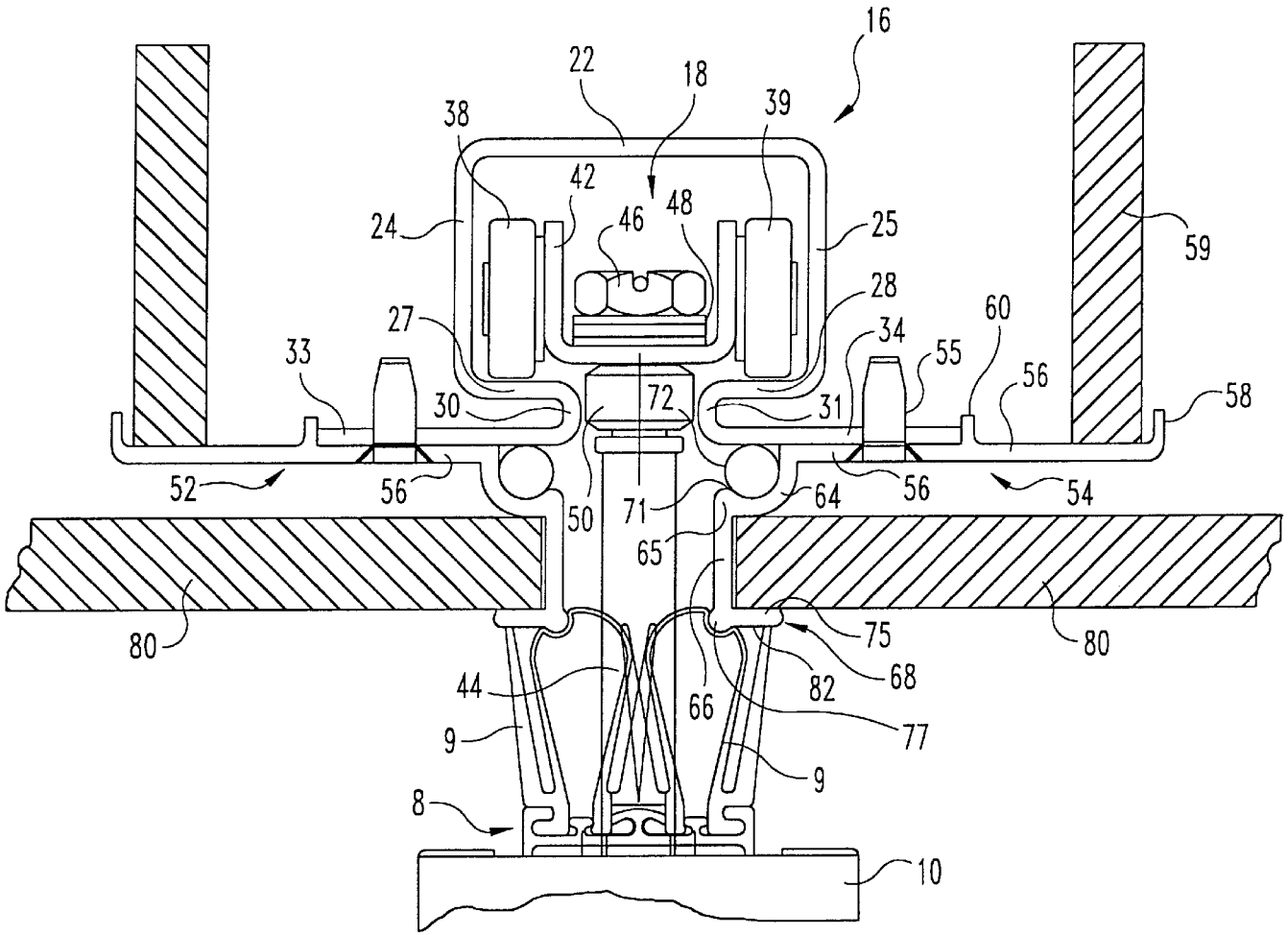
FIG. 2 is a cross-sectional view, conceptually taken along line 2—2 of FIG. 1, further illustrating a first embodiment of a track concealing system of the present invention in use, wherein the room ceiling not shown in FIG. 1 is now shown, and wherein the trolley is connected to an abstractly shown operable wall panel.
Figure 3:
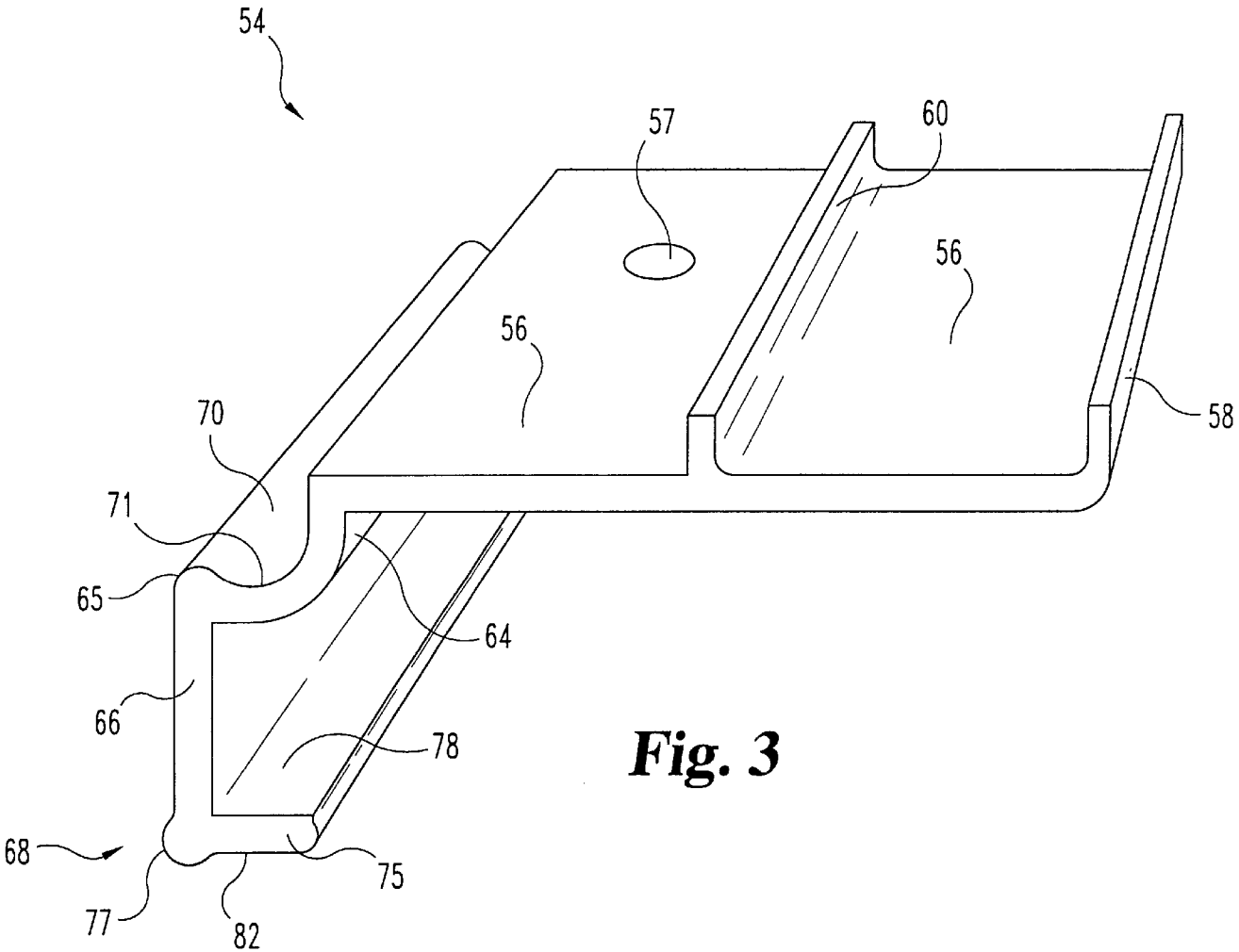
FIG. 3 is a partial perspective view of a ceiling suspending bracket of FIG. 2 removed from the remainder of the track.

With reference now to FIGS. 2 and 3, one configuration of the track, trolley and a first embodiment of a track concealing system of the present invention is further described. Track 16 is of a known design and is made of hardened cold-rolled steel in a generally square tubed shape including a top wall 22, vertical side walls 24 and 25, and bottom wall portions 27 and 28. Track 16 may be mounted to the ceiling support structure by any means known in the art, such as by not shown hanger brackets positioned at spaced intervals along the length of the track.

The upper surfaces of bottom wall portions 27 and 28 are the surfaces along which the wheels of trolley 18 roll when the wall panel is moved. The inward facing regions of bottom wall portions 27 and 28 are integrally formed with bend sections 30, 31, respectively, that are horizontally spaced to provide a slot or gap through which vertically extends trolley bolt 44. The lower ends of bend sections 30, 31 are integrally formed with laterally extending, horizontal flanges 33, 34, respectively, that outwardly extend beyond the vertical plane of side walls 24 and 25. The cross-sectional configuration of track 16 shown in FIG. 2 generally corresponds to its configuration along its entire axial length.

The trolley 18 shown is of a conventional, four-wheel design and is intended to be illustrative and not limiting, as other trolleys may be employed. Trolley 18 includes a pair of wheels 38 that roll along track portion 27 and a pair of wheels 39 that roll along track portion 28. Portions of the axles that mount the wheels are not shown to facilitate illustration. Wheels 38 and 39 are rotatably mounted on a U-shaped base plate 42 with a central bore through which rotatably extends a steel trolley bolt 44. The enlarged head 46 of trolley bolt 44 extends through a thrust bearing assembly 48 which is sandwiched between the underside of bolt head 46 and the upper surface of base plate 42. In FIG. 2, the bolt head is shown as a nut which is attached to a threaded section of a rod that serves as the bolt, which nut is shown secured with a transversely extending pin. Other bolt heads can be formed as well. Thrust bearing assembly 48 permits relative rotation of trolley bolt 44 to base plate 42. A pair of rotatable wheel assemblies 50 are mounted to the underside of plate 42 so as to flank bolt 44 on its leading and trail sides, and serve to rollingly engage track bend sections 30, 31 during trolley movement. The distal or lower end of trolley bolt 44 is attached to the top end of operable partition 10, which is abstractly shown. The method of attachment of trolley bolt 44 to panel 10 is not shown or fully described herein as it may be of any type that is known in the art, as the particular form of the connection is not material to the present invention. Panel 10 is shown including an automatic operable top seal 8 that moves vertically from a lowered or retracted position to the operable position shown in which the resilient sweeps 9 engage for acoustical reasons the ceiling mounting brackets described further below.

Attached to track flanges 33, 34, respectively, are ceiling mounting brackets or soffit portions generally designated 52 and 54. Brackets 52 and 54 extend the entire length of track 16, and the shown cross-sectional configuration of brackets 52 and 54 generally corresponds to the configuration of each bracket along its entire axial length. In the partial perspective view of FIG. 3, bracket 54 is shown removed from track 16 and alone. As brackets 52 and 54 are mirror images of one another, the following description of bracket 54 will be recognized as having equal application to bracket 52. Bracket 54 is formed in one-piece from a lightweight but strong material, such as of aluminum, in an extrusion molding process. Bracket 54 is installed along the entire track length in segments that are assembled end-to-end. Although the length of the bracket segments may vary, such segments are typically about ten feet long so as to be easily worked with by an installer.

Bracket 54 includes a plate shaped body section 56 with a generally uniform thickness of about ⅛ inch. Bracket 54 is mounted to track flange 34 via self-tapping screws 55, or other fasteners such as rivets, that pass through axially spaced holes 57 in body section 56 and which insert through aligned holes in track flange 34. The laterally outward edge of body section 56 is bent upward and tapered in thickness at 58. Edge 58 flanks and is in close proximity to, or alternatively directly abuts, the outside face of the bottom edge of a sound baffle 59, such as a panel of plasterboard, that is frequently attached at its upper, not shown end to the ceiling support structure in an effort to prevent sound from traveling over the track between rooms formed by the operable wall. Upturned bracket edge 58 aids in locating the sound baffle and in preventing sound from passing underneath sound baffle 59, and is shown as being about ¼ inches in height. Other heights of bracket edge 58, such as within the range of 3⁄16 to 5⁄16 inches, may alternatively be employed.

Upwardly projecting from the top surface of body section 56 is a rectangular ridge 60 that serves as a lateral stop member during bracket installation. Ridge 60 is designed to extend slightly above flange 34, and typically is about ⅛ to 3⁄16 inches in height. Ridge 60 is spaced from the laterally inward extent of bracket 54 based on the horizontal width of flange 34 with which bracket 54 will be employed, and is designed to abut the end of flange 34 at a point where bracket 54 is properly located under track 16 and trolley 18, such as where the minimum spacing between brackets 52 and 54 equals or is slightly greater than the spacing between track bend sections 30 and 31. Although ridge 60 is shown as continuous along the axial length of the bracket, such a configuration is a result of the extrusion molding process, as the stop could be provided in other manners, such as in the form of detents positioned at axial intervals along the bracket length.

The inward edge of body section 56 is integrally formed with a downwardly and inwardly extending arcuate section 64 that terminates in the vertical leg 66 of an L-shaped panel support, generally designated 68. Arcuate section 64 defines an inward facing hollow 70 into which is preferably installed a strip light or illuminating element, abstractly shown at 72, that is electrically attached to a not shown power source at a track end, such as at the location where the panels are stacked or at the lead end of the track. The strip light is optional. Arcuate section 64 preferably extends upward at its inward end 65 a sufficient distance above the bottom of hollow 70 so that a shallow groove 71 spanning greater than 180° is formed in which illuminating element 72 may be captured without the use of additional fasteners. Fasteners also may be used.

Illuminating element 72, which continuously extends along the entire bracket length, functions to light up the gap between brackets 52 and 54, as well as to partially illuminate the room. One suitable illuminating element 72 is a cord of lights available from National Speciality Lighting, Inc., of Louisville, Colo., under the product name of Light Rope 500. Rather than extending continuously, the light cord may be installed at only selected sections of the track length, but such installation may require more power source wiring.

L-shaped panel support 68 includes a support ledge 75 arranged perpendicular to vertical leg 66. A rounded ridge 77 that protrudes inwardly at the bottom end of vertical leg 66 is designed to be the point of contact by panel support 68 with the trolley bolt 44 when the panel sways to maintain low the frictional resistance to trolley movement by that contact.

The upper surface 78 of support ledge 75 functions as a ledge that supports the edge of the ceiling element, generally designated 80, installed thereon. Ceiling element 80 is the same material as the rest of the ceiling adjacent the track and of the room in which the operable wall is installed. For example, ceiling element 80 may be tiles of a suspended ceiling, or possibly plasterboard also known as drywall or gypsum. Ceiling element 80, and more specifically portions of the ceiling element having bottom surface area uncovered by the ceiling mounting bracket, is directly below portions of the trolley, as well as the track.

Support ledge 75 has a relatively small width or horizontal profile such that its downward facing bottom surface 82 is relatively inconspicuous in the ceiling to an observer in the room. Bottom surface 82 is preferably sufficiently wide to be engaged by retractable or operable acoustical sweeps 9 mounted to the panel which may be pressed into contact with surface 82 to provide a sound seal between the panel and the ceiling. In the shown embodiment, support ledge 75 has a thickness of about ⅛ inch and horizontally juts outward beyond vertical leg 66 a distance of about ⅜ inches, and preferably juts outward within the range of about ¼ and 3.0 inches, and more preferably within the range of about ⅜ and ¾ inches. For a thickness of about ⅛ inches for vertical leg 66 and a protruding height of ridge 77 of about 5⁄64 inches, surface 82 has a downward facing width of about 37⁄64 inches in the shown embodiment. As a result, when the track slot or gap between ridges 77 of brackets 52 and 54 is about ¾ inches for a ½ inch diameter trolley bolt, the distance between the outward edge of support ledge 75 of bracket 52 and the outward edge of support ledge 75 of bracket 54 is about 1.9 inches.

Figure 4:
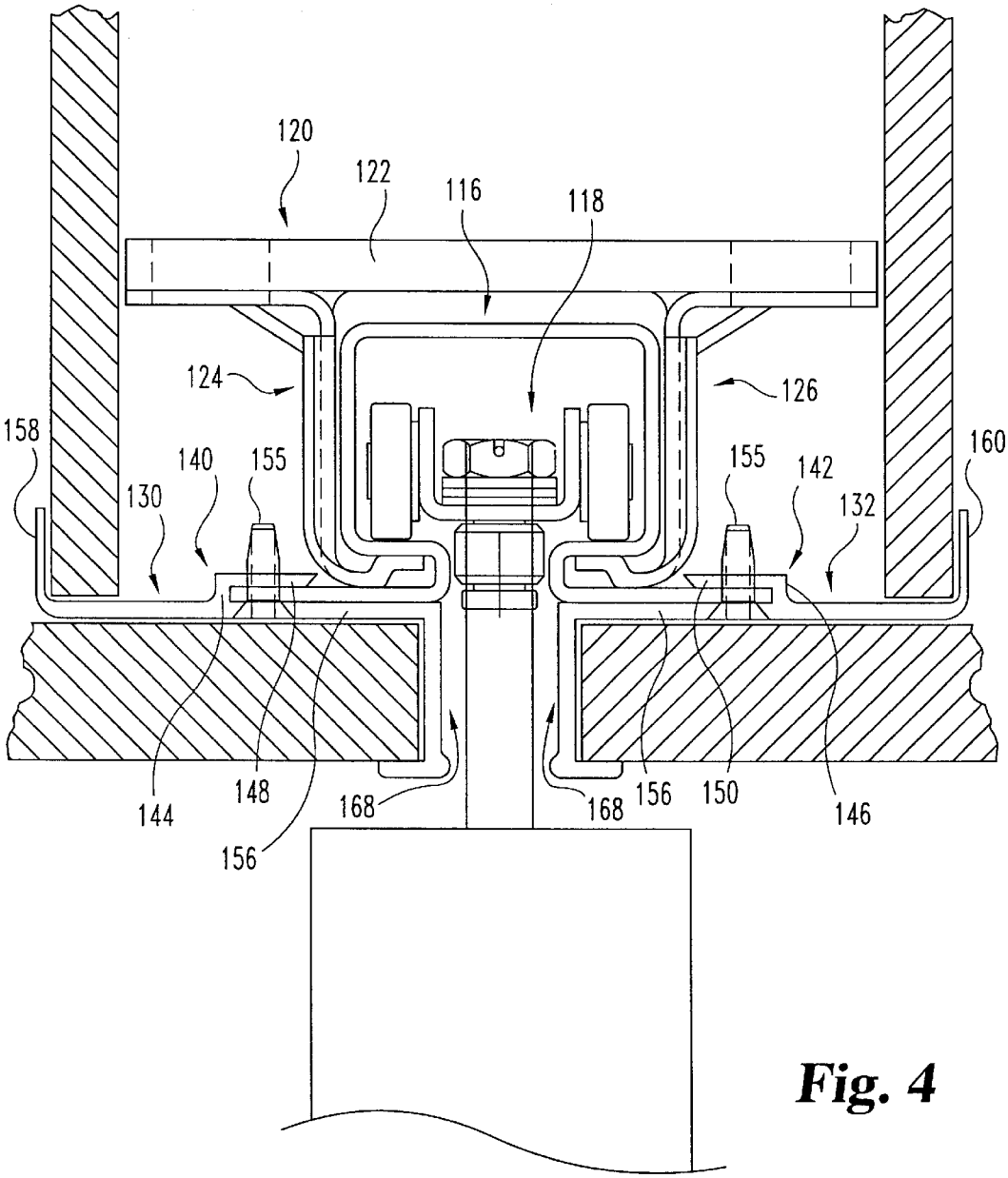
FIG. 4 is a cross-sectional view similar to FIG. 2 illustrating an alternate embodiment of a track concealing system of the present invention, and wherein one of the hanger bracket assemblies used to suspend the track from the support structure is also shown.

Referring now to FIG. 4, there is shown a second embodiment of a track concealing system of the present invention. The track 116 and trolley 118 are identical to the track 16 and trolley 18 shown in the embodiment illustrated in FIG. 2. Track 116 is mounted to the ceiling support structure by means of hanger brackets, such as shown at 120, positioned at spaced intervals along the length of the track. Hanger bracket 120 includes top bar 122 to which is welded a pair of gusseted and reinforced support members 124 and 126 that fit under and support track 116. Not shown hanger rods and securing nuts are used to mount the hanger bracket 120 to the support structure in a conventional manner.

Ceiling mounting brackets 130 and 132 are attached to horizontal flanges of track 116. Bracket 130 and 132 are similar in most respects to brackets 52 and 54 described above, and therefore explanation herein is generally limited to the differences therebetween. Ceiling brackets 130 and 132 include L-shaped hooks 140 and 142, instead of upstanding ridges 60, that extend along the bracket length. The vertical legs 144, 146 of hooks 140 and 142 serve as stop members to control the lateral placement of the brackets relative to the track 116 during installation, and the horizontal legs or lip sections 148, 150 of hooks 140 and 142 fit over the track flanges and serve to hold the brackets in place during bracket installation prior to the fixed securement of the brackets to the track with screws 155. The laterally outward edges 158, 160 of the brackets have a higher vertical profile than bracket edge 58, and are shown extending upward a height of about 5⁄16 inches. Ceiling mounting brackets 130 and 132 lack the strip light mounting recess shown in the embodiment of FIG. 2, and consequently the inward end of body section 156 of each bracket is integrally formed with the vertical leg of an L-shaped panel support, generally designated 168.

Figure 5:
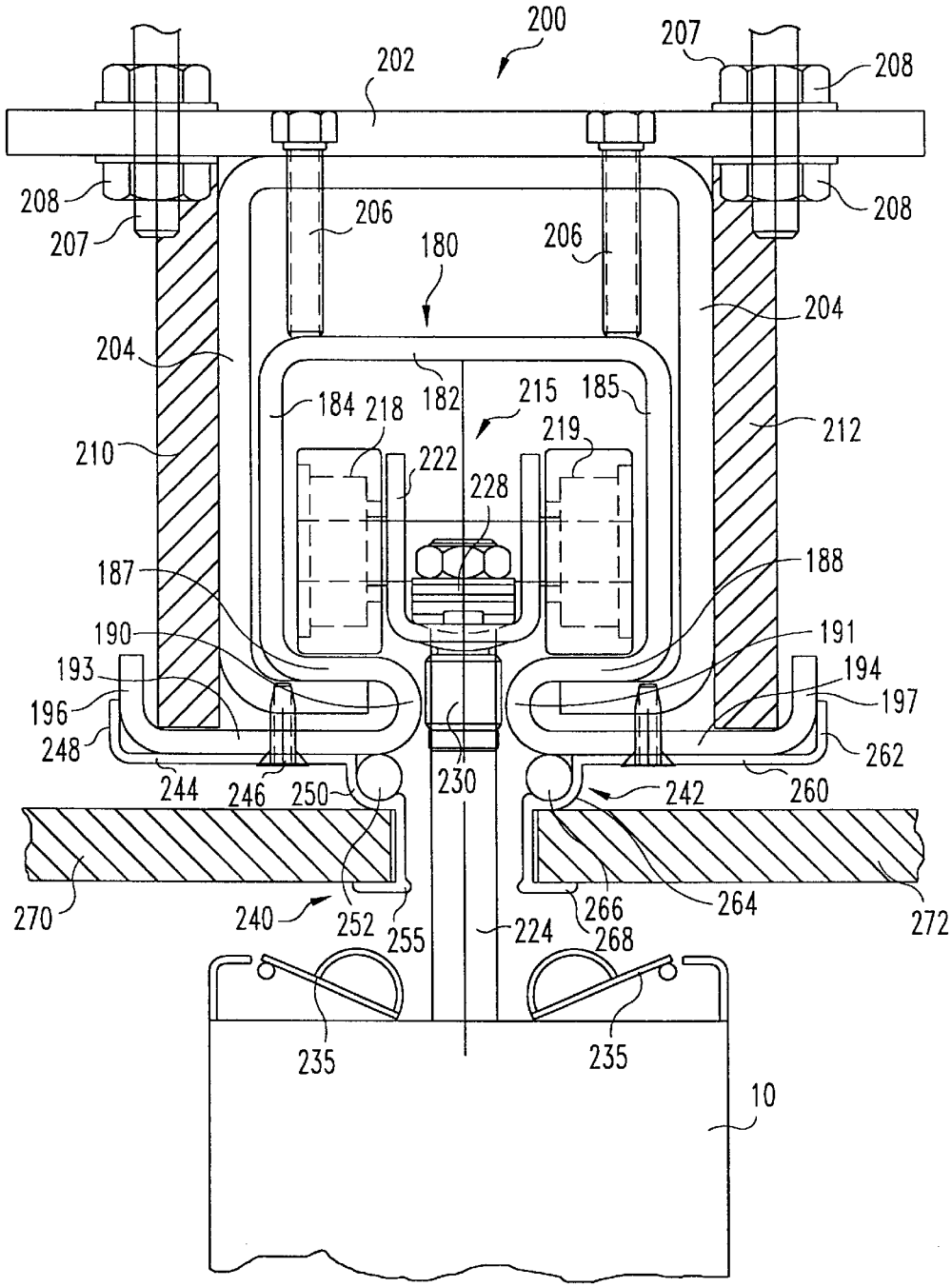
FIG. 5 is a cross-sectional view similar to FIG. 2 illustrating an alternate embodiment of a track and track concealing system of the present invention.

Referring now to FIG. 5, there is shown still another embodiment of a track concealing system of the present invention for use with a differently configured track. Track 180 is similar to track 16 and includes a top wall 182, vertical side walls 184 and 185, and bottom wall portions 187 and 188. Bottom wall portions 187, 188 are integrally formed with bend sections 190, 191 that turn out into laterally extending, horizontal flanges 193,194, respectively, that include upturned ends 196, 197. The cross-sectional configuration of track 180 shown corresponds to its configuration along its entire axial length.

Track 180 is mounted to the ceiling support by hanger brackets, such as shown at 200, positioned at spaced intervals along the track length. Hanger bracket 200 includes top bar 202 to which is welded a channel segment 204 that supportably extends under track 180. Screws 206 that insert through tapped holes in channel segment 204 are tightened against top wall 182 to retain track 180 within channel segment 204. A pair of hanger rods 207 and associated securing nuts 208 are used to mount the hanger bracket 200 to the support structure in a conventional fashion. Sound baffling panels 210 and 212 that extend along the track length are mounted to the support structure and abut the upper surface of track flanges 193 and 194 to limit sound transmission over the track.

Trolley 215 is similar to trolley 18 of FIG. 2 and includes a pair of wheels 218, a pair of wheels 219, a U-shaped base plate 222 through which extends a trolley bolt 224, a thrust bearing assembly 228 around bolt 224, and wheel assemblies 230 flanking bolt 224. The lower end of trolley bolt 224 is attached to the upper end of an abstractly shown operable partition 10 in a conventional fashion. Panel 10 includes a pair of operable acoustical sweeps or seals 235 that are rotatable from the retracted position shown to a sealing position in which their elastomeric structure achieves a sound barrier seal with the bottom surface of the ceiling mounting brackets 240 and 242.

Attached to track flanges 193, 194, respectively, are mirror image ceiling mounting brackets 240 and 242 that extend the entire length of the track 180 in the configuration shown. Each bracket is formed in one-piece of aluminum in an extrusion molding process. Bracket 240 includes a plate shaped body section 244 with axially spaced holes therethrough that accommodate self-tapping screws 246 insertable into holes in track flange 193 to mount bracket 240 to the track. The laterally outward edge 248 of body section 244 is bent upward about ½ inches and is of a reduced thickness and directly abuts the upturned track end 193 to serve as a lateral stop member during bracket installation. The inward edge of body section 244 is integrally formed with arcuate section 250 that provides a seat for electrical strip light 252. Bracket arcuate section 250 terminates in an L-shaped panel support 255 that extends under and supports the edge of the ceiling element shown at 270.

Bracket 242 similarly includes plate shaped body section 260, an upward bent end 262 that serves as a lateral stop member during installation of bracket 242, arcuate section 264 with strip light 266, and an L-shaped panel support 268 that supports ceiling element 272.

Figure 6:
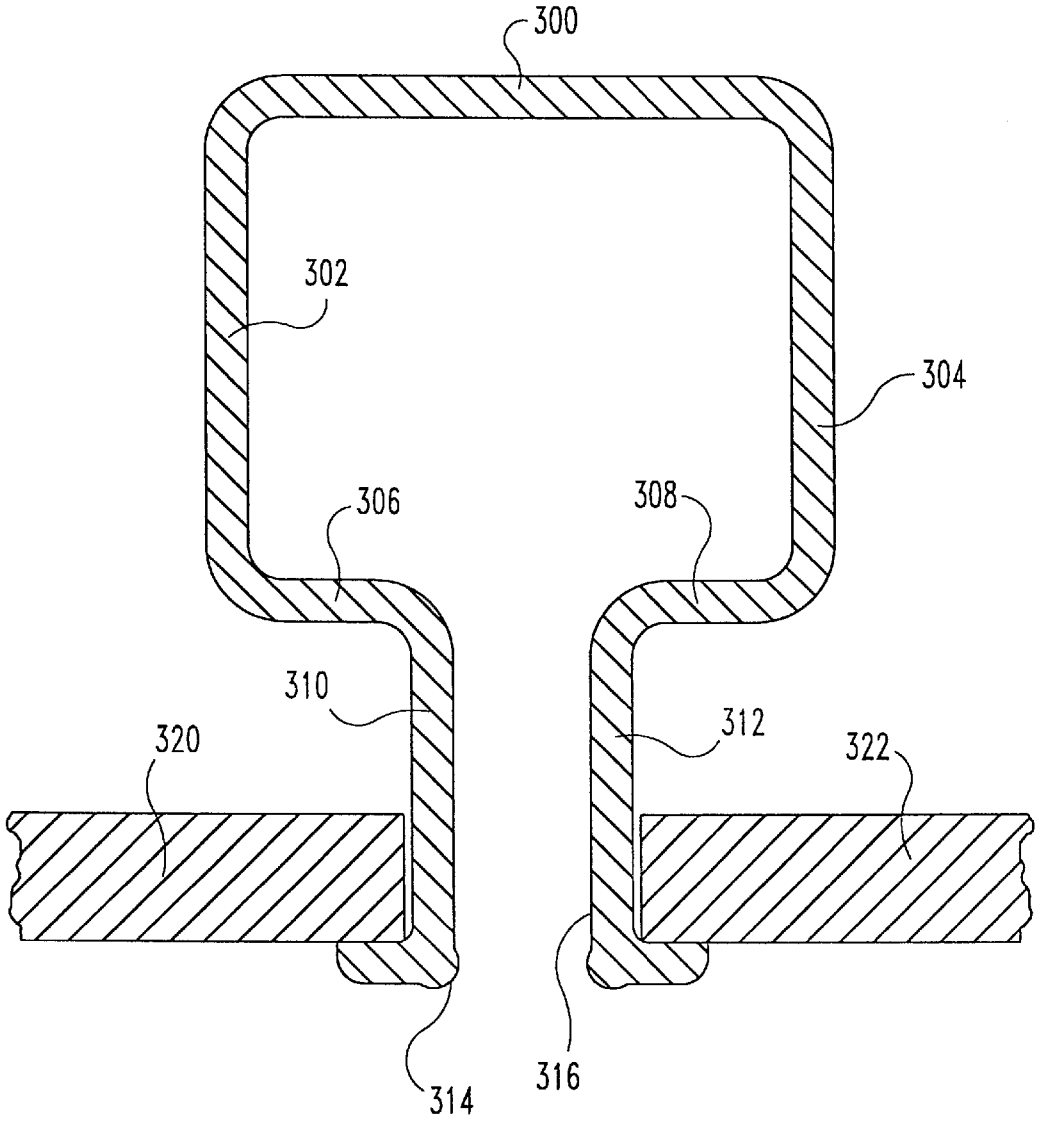
FIG. 6 is a cross-sectional view similar to FIG. 2 of still another embodiment of a track concealing system of the present invention integrated into a trolley track, wherein a trolley is not shown.

Referring now to FIG. 6, there is shown still another embodiment of a track concealing system of the present invention integrated into a trolley track. In this embodiment, which requires a custom made track part as opposed to the tracks shown in the other figures which are already known in the art, the track includes a top wall 300, vertical side walls 302 and 304, and bottom wall portions 306 and 308 upon which the not shown trolleys ride. Bottom wall portions 306 and 308 are integrally formed with depending flanges 310 and 312 that at their lower ends terminate in L-shaped panel support portions 314 and 316 similar to the supports 68 of the embodiment shown in FIG. 2. Support portions 314 and 316 suspend ceiling panels 320 and 322 directly below the track and the not shown trolley.

Although this invention has been shown and described as concealing a track installed in a ceiling support structure, it is contemplated that this invention can also be used to conceal tracks installed in other structures, such as walls and floors.

While this invention has been shown and described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A track concealment system for use with a movable wall system, the movable wall system having a track defining an elongated passageway extending the length of the track and a track opening in communication with the passageway and extending the length of the passageway, the track positioned adjacent to a ceiling defining a ceiling opening in communication with the track opening and extending the length of the passageway; at least one movable wall having an upper end; at least one trolley slidingly disposed within the passageway of the track; and a connecting member attached to the upper end of the movable wall at one end and extending through both the track opening and the ceiling opening to engage the trolley at a second end, the track concealment system comprising:

a pair of ceiling elements disposed within the ceiling to define a portion of the ceiling opening, each of said ceiling elements having an edge and sized to conceal a portion of the track; and a pair of brackets each having a first portion attachable to the track and a second portion configured to support said edge of a corresponding one of said ceiling elements such that said edge of said ceiling element is adjacent the connecting member thereby concealing the track.

2. The track concealment system of claim 1, wherein:

said first portion of said bracket defines a body portion engageable to the track, said body portion having a first end and a second end; and said second portion of said bracket defines a support ledge spaced apart from said body portion for supporting said edge of one of said ceiling elements.

3. The track concealment system of claim 1, wherein said pair of brackets extend the length of the track.

4. The track concealment system of claim 1, wherein at least one of said pair of brackets defines a groove between said first portion and said second portion and further comprises a light strip mounted in said groove.

5. The track concealment system of claim 1, wherein at least one of said pair of brackets defines a third portion defining a groove, said second portion and said third portion cooperate to engage said edge of one of said ceiling elements, said third portion further comprising a light strip mounted in said groove.

6. A track concealment system of claim 1, the track including a flange, wherein said first portion defines a hook configured to engage the flange of the track to secure said bracket to the track.

7. The track concealment system of claim 1, further comprising at least one sweep, said sweep mountable to the movable wall and extending from the upper end of the movable wall to said second portion of said bracket thereby concealing the connecting member.

8. The track concealment system of claim 7, wherein said sweep is rotatable from a retracted position, exposing said connecting member, to a sealing position, contacting said second portion to conceal the connecting member.

9. The track concealment system of claim 8 wherein said second portion of each of said pair of brackets defines a rounded ridge, said rounded ridge configured to engage said sweep to secure said sweep in said sealing position.

10. The track concealment system of claim 1, wherein said pair of brackets, when engaged to the track, define a gap configured to receive the connecting member, and said second portion of each of said pair of brackets defines a rounded ridge extending inwardly of said gap, said rounded ridge configured to limit movement of the connecting member within said gap.

11. A track concealment system for use with a movable wall system and disposed within a room with a ceiling having a ceiling opening defined by first and second ceiling edges, comprising:

a track defining an elongated passageway extending the length of said track, and defining a track opening in communication with said passageway, said track opening extending the length of said passageway, said track positioned adjacent to the ceiling with the ceiling opening being in communication with said track opening the length of said passageway;

at least one movable wall;

at least one trolley slidingly disposed within said passageway of said track;

a connecting member attached to said movable wall at one end and extending through both said track opening and said ceiling opening to engage said trolley at a second end; and a pair of brackets each having a first portion attachable to said track and a second portion configured to support a corresponding one of the ceiling edges such that the ceiling edge is adjacent said connecting member thereby concealing said track.

12. A track concealment system for use with a movable wall system and disposed within a room with a ceiling having a ceiling opening defined by first and second ceiling edges, the movable wall system having a track defining a flange, an elongated passageway extending the length of the track, and a track opening in communication with the passageway and extending the length of the passageway, the track positioned adjacent to the ceiling with the ceiling opening being in communication with the track opening and extending the length of the passageway; at least one movable wall; at least one trolley slidingly disposed within the passageway of the track; and a connecting member attached to the movable wall at one end and extending through both the track opening and the ceiling opening to engage said trolley at a second end, the track concealment system comprising:

a bracket having a body portion engageable to the track, said body portion having a first end and a second end, said body portion defining a hook configured to engage the flange of the track to secure said bracket to the track, said second end of said body portion defining an upturned bracket edge;

a vertical leg extending from said first end of said body portion; and a support ledge extending from said vertical leg, said support ledge spaced apart from said body portion and configured to support a corresponding one of the ceiling edges, said vertical leg defining a rounded ridge.

* * * * *